United States Patent [19]

Folkins

[11] Patent Number: 4,603,961

[45] Date of Patent: Aug. 5, 1986

[54] DEVELOPMENT SYSTEM

[75] Inventor: Jeffrey J. Folkins, Rochester, N.Y.

[73] Assignee: Xerox Corporation, Stamford, Conn.

[21] Appl. No.: 744,184

[22] Filed: Jun. 13, 1985

[51] Int. Cl.[4] ..... G03G 15/09

[52] U.S. Cl. ..... 355/3 DD; 355/14 D; 118/658; 430/122

[58] Field of Search ..... 355/3 DD, 14 D, 3 R, 355/14 R; 118/658; 430/122

[56] References Cited

U.S. PATENT DOCUMENTS

| | | | |
|---|---|---|---|
| 4,194,828 | 5/1980 | Holz et al. | 355/3 |
| 4,277,549 | 7/1981 | Tatsumi et al. | 355/14 D X |
| 4,286,031 | 8/1981 | Kuehnle et al. | 355/14 D X |
| 4,338,019 | 7/1982 | Terashima et al. | 355/14 D |
| 4,378,158 | 3/1983 | Kanbe | 355/3 DD |
| 4,439,034 | 3/1984 | Daniels | 355/3 DD |
| 4,482,243 | 11/1984 | Suzuki et al. | 355/14 D |
| 4,533,234 | 8/1985 | Watai et al. | 355/14 D |
| 4,553,827 | 11/1985 | Mayer | 355/3 DD |

OTHER PUBLICATIONS

Ser. No. 392,965, filed 6/1982, Folkins.
Ser. No. 490,267, filed 5/1983, Folkins.

*Primary Examiner*—A. C. Prescott
*Attorney, Agent, or Firm*—H. Fleischer; J. E. Beck; R. Zibelli

[57] ABSTRACT

An electrophotographic printing machine of the type having a photoconductive member wherein at least one electrostatic latent image is recorded thereon. A developer roller transports a developer material closely adjacent to the photoconductive member. A controller, coupled to the developer roller, generates a control signal as a function of the measured electrical potential on the photoconductive member. A second developer roller, spaced from the first developer roller, is electrically biased to a fixed potential to deposit developer material on the latent image. A third developer roller, spaced from the second developer roller, also develops the latent image with developer material. The second developer roller is interposed between the first developer roller and the third developer roller. The electrical bias on the third developer roller is controlled by the control signal from the controller.

10 Claims, 2 Drawing Figures

DEVELOPMENT SYSTEM

Figure 1:
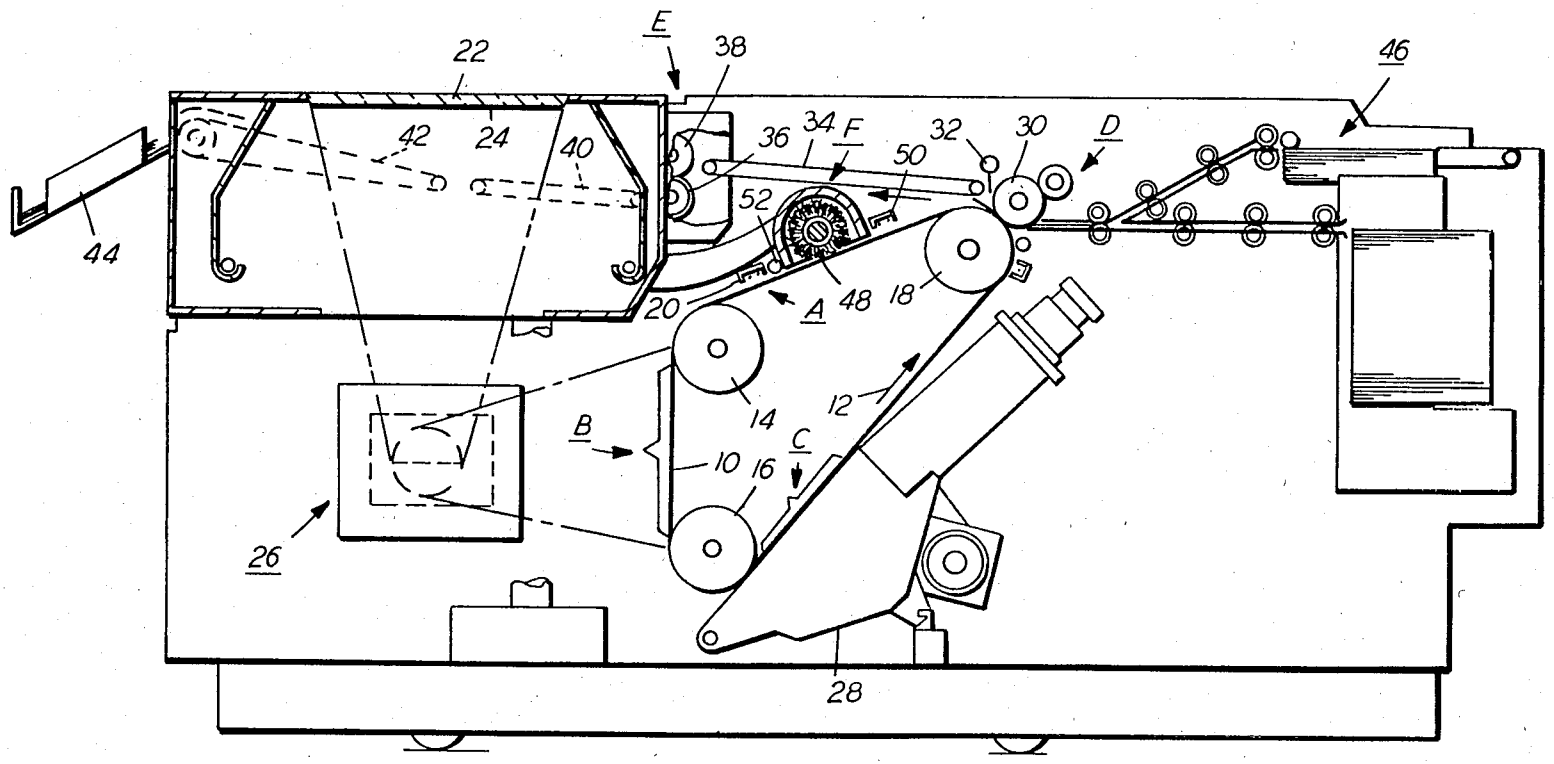

This invention relates generally to an electrophotographic printing machine, and more particularly concerns an apparatus which develops an electrostatic latent image recorded on a photoconductive surface.

In the process of electrophotographic printing, a photoconductive surface is uniformly charged and exposed to a light image of an original document. Exposure of the photoconductive surface records an electrostatic latent image corresponding to the informational areas contained within the original document. After the electrostatic latent image is recorded on the photoconductive surface, the latent image is developed by bringing a developer material into contact therewith. Generally, the developer material comprises toner particles adhering triboelectrically to carrier granules. The toner particles are attracted from the carrier granules to form a toner powder image on the photoconductive surface which corresponds to the informational areas contained within the original document. The toner powder image is subsequently transferred to a copy sheet and permanently affixed thereto in image configuration.

Although various types of photoconductive members are employed, it has been found that the electrical characteristics thereof are not necessarily always repeatable. Frequently, the characteristics of the photoconductive surface vary with useage, e.g. dark decay, etc. This causes difficulty in repeating the potential on the photoconductive surface for successive cycles at the various processing stations employed in the printing machine. One method of compensating for the variations in the electrical characteristics of the photoconductive surface is to measure the potential thereon. Heretofore, various type of electrometers have been employed to detect the electrical characteristics of the photoconductive surface. The major advantage of an electrometer is that it provides a direct measurement of the charge actually on a specific portion at the time the surface passes beneath the electrometer. The use of electrometers in electrophotographic printing machines is well known in the art. For example, U.S. Pat. Nos. 2,781,705 issued in 1957 to Crumrine et al., 2,852,651 issued in 1958 to Crumrine et al., 2,956,487 issued in 1962 to Giamo, Jr., 3,013,203 issued in 1961 to Allen et al., 3,068,056 issued in 1962 to Kodichini, 3,321,307 issued to Urbach in 1967, 3,406,334 issued in 1969 to Marquart et al., 3,483,705 issued in 1969 to King, 3,611,982 issued in 1971 to Coriale, 3,654,893 issued in 1972 to Piper et al., 3,674,353 issued in 1972 to Tractenberg and 3,749,488 issued in 1973 to Delome, all describe various types of electrometers used to measure the characteristics of the photoconductive surface.

As a practical matter, the commercial application of electrometers in electrophotographic printing machines has been hampered by their high cost, complexity and the instability of the systems. Most of the foregoing systems have required choppers or vibrating probes, and expensive high voltage amplifiers and feedback circuits. However, these patents illustrate the highly developed nature of the art. Other patents which use electrometer systems are U.S. Pat. Nos. 3,370,225, issued in 1968 to Winder and 3,449,668 issued in 1969 to Blackwell et al. Examples of electrometer systems are also disclosed in various texts. "Electrophotography" by Schaeffert and "Xerography and Related Processes" by Dessauer and Clark, both published in 1965 by Focal Press, LTD., London, England, Pages 99–100, inclusive, and 213–216, inclusive of "Electrophotography" relate specifically to electrometers. Furthermore, the following disclosures appear to be relevant:

U.S. Pat. No. 4,194,828; Patentee: Holz et al.; Issued: May 25, 1980.

Co-pending U.S. Ser. No. 392,965; Applicant: Folkins; Filed: June 28, 1982.

Co-pending U.S. application Ser. No. 490,267; Applicant: Folkins; Filed: May 2, 1983.

The pertinent portions of the foregoing disclosures may be briefly summarized as follows:

Holz et al. discloses a development electrode including a metal roller which transfers developer material to a photoconductive surface. The development electrode is used to measure the background voltage of an image free portion of the photoconductive surface and to control the development voltage biasing the development electrode in accordance with the measured background voltage.

Folkins, U.S. Ser. No. 392,965, discloses a magnetic brush system which operates in the developing or cleaning mode. When measuring the potential on the photoconductive surface, the voltage source electrically biasing the magnetic brush roller is disconnected therefrom, and the roller allowed to be electrically floating. The floating voltage is sensed in the inter-image region. The sensed electrical voltage corresponds to the potential on the photoconductive surface and is used to control the various processing stations within the printing machine.

Folkins, U.S. Ser. No. 490,267, discloses a developer roller which advances developer material closely adjacent to a photoconductive surface. An electrical bias of a selected magnitude and polarity is applied to the developer roller. The electrical biasing current is sensed and a signal indicative of the electrical potential on the photoconductive surface transmitted. This signal may be used to control the various processing stations within the electrophotographic printing machine.

In accordance with the features of the present invention, there is provided an electrophotographic printing machine of the type having a photoconductive member with at least one electrostatic latent image recorded thereon. Means support a developer material closely adjacent to the photoconductive member. Means, coupled to the supporting means, generate a control signal as a function of the electrical potential on the photoconductive member. First means develop the electrostatic latent image. First means electrically bias the first developing means to a substantially fixed electrical bias. Second means develop the electrostatic latent image. The first developing means is interposed between the second developing means and the supporting means. Second means, responsive to the control signal from the generating means, electrically biases the second developing means.

Figure 2:
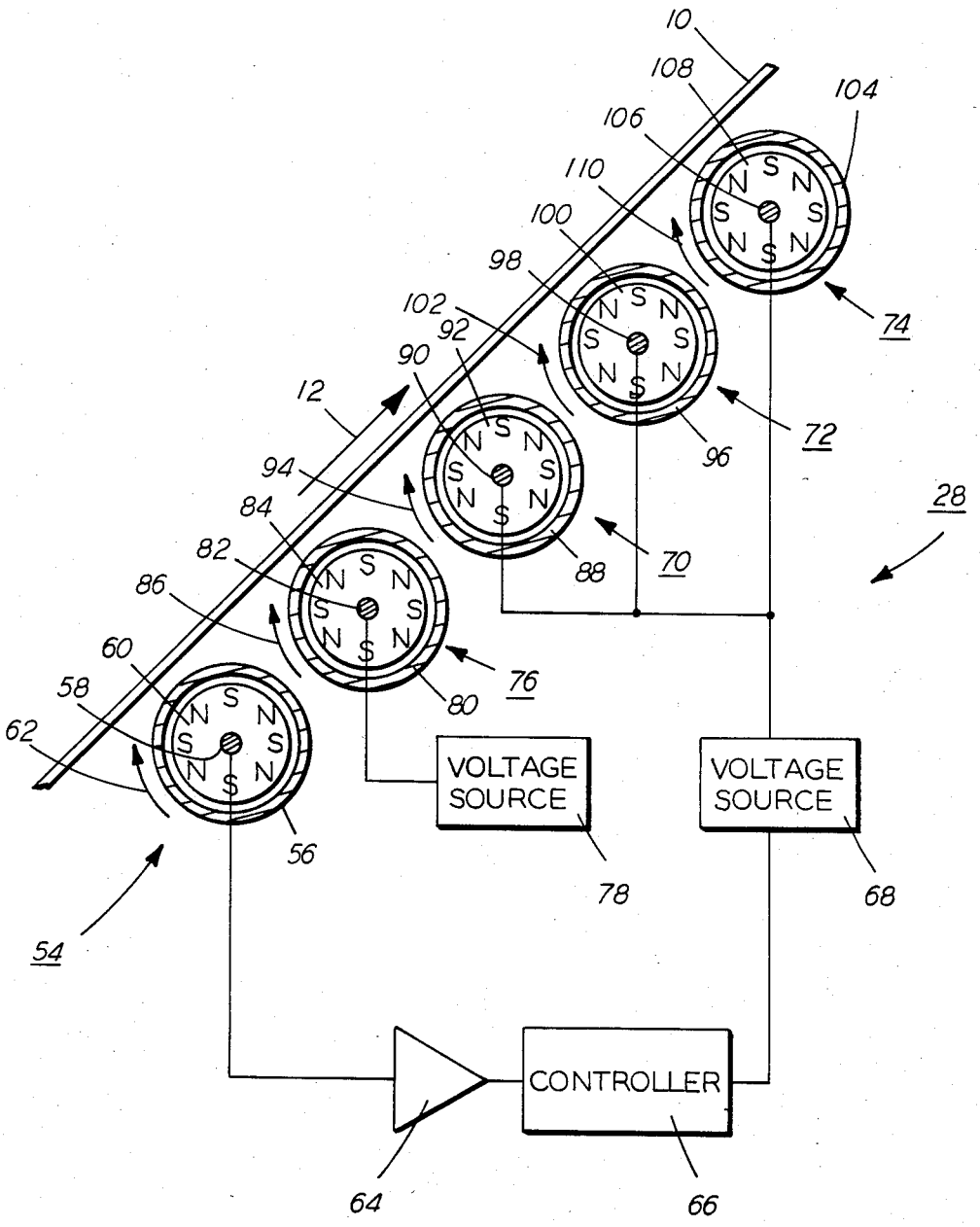

Other aspects of the present invention will become apparent as the following description proceeds and upon reference to the drawings, in which:

FIG. 1 is a schematic elevational view showing an illustrative electrophotographic printing machine incorporating the features of the present invention therein; and FIG. 2 is a schematic elevational view showing the development system of the FIG. 1 printing machine.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development system of the present invention therein. It will become evident from the following discussion that this development system is equally well suited for use in a wide variety of electrostatographic printing machines, and is not necessarily limited in its application to the particular embodiment depicted herein.

Inasmuch as the art of electrophotographic printing is well known, the various processing stations shown schematically in the FIG. 1 printing machine will be described briefly with reference thereto.

As shown in FIG. 1, the illustrative electrophotographic printing machine employs a belt 10 having a photoconductive surface, adhering to a conductive substrate. Preferably, the photoconductive substrate is made from a selenium alloy with the conductive substrate being made from an electrically grounded aluminum alloy. Belt 10 moves in the direction of arrow 12 to advance successive portions of the photoconductive surface sequentially through the various processing stations disposed about the path of movement thereof. Belt 10 is entrained about spaced rollers 14, 16 and 18.

Initially, a portion of the photoconductive surface passes through charging station A. At charging station A, a corona generating device, indicated generally by the reference numeral 20 charges the photoconductive surface to a relatively high, substantially uniform potential.

Next, the charged portion of the photoconductive surface is advanced through imaging station B. At imaging station B, an original document 22 is placed upon a transparent support platen 24. While upon platen 24, an exposure system, indicated generally by the reference numeral 26, flashes light rays upon original document 22 thereby producing image rays corresponding to the informational areas of original document 22. The image rays are projected by means of the optical system of exposure system 24 onto the charged portion of the photoconductive surface. As the photoconductive surface is illuminated with the image rays, the charge thereon is selectively discharged recording an electrostatic latent image, i.e. the image region on the photoconductive surface of belt 10. Thereafter, belt 10 advances the electrostatic latent image recorded on the photoconductive surface to development station C.

At development station C, a magnetic brush development system, indicated generally by the reference numeral 28 transports a developer mixture of carrier granules having toner particles adhering triboelectrically thereto into contact thereto with the electrostatic latent image. Development system 28 comprises a plurality of magnetic brush developer rollers which advance the developer material to the adjacent surface of the upwardly moving inclined photoconductive belt 10 in order to provide development of the electrostatic latent image. The latent image attracts the toner particles from the carrier granules forming a powder image on the photoconductive surface of belt 10. The detailed structure of development system 28 will be described hereinafter with reference to FIG. 2.

After development, belt 10 advances the toner powder image to transfer station D. At transfer station D, a sheet of support material, moving at a speed in synchronism with belt 10, contacts the toner powder image. Transfer station D includes a transfer roller 30, which contacts the non-transfer side of each sheet of support material as the sheet is brought into transfer engagement with the photoconductive surface of belt 10. Transfer roller 30 is electrically biased with sufficient voltage so that the toner powder image on the photoconductive surface of belt 10 is electrically transferred to the adjacent side of the sheet of support material as it is brought into contact therewith. A stripping finger or air puffing device 32 strips the sheet of support material from roller 30 to permit fusing.

Fusing station E includes a heated fuser roller 36 and a back-up roller 38. The sheet passes between fuser roller 36 and back-up roller 38 with the powder image contacting fuser roller 36. In this manner, the powder is permanently affixed to the sheet. After fusing, conveyors 40 and 42 advance the sheet to catch tray 44 for subsequent removal from the printing machine by the operator.

There is also provided within the printing machine a suitable sheet transport mechanism, indicated generally by the reference numeral 46, adapted to transport sheets of support material, in seriatim, to transfer station D. A programming device, operatively connected to sheet transport 46, insures that the sheets of support material are advanced to transfer station D in a sequence timed to the arrival of the toner powder image thereat. In this way, the toner powder image and the sheet of support material are in registration with one another at transfer station D.

With continued reference to FIG. 1, after the powder image is transferred from the photoconductive surface to the sheet of support material, belt 10 advances the photoconductive surface to cleaning station F. At cleaning station F, a rotating brush 48, removes the residual particles adhering to photoconductive belt 10. These residual particles have had the charge thereon neutralized by corona generating device 50. Lamp 52 illuminate the photoconductive surface of belt 10 to discharge any residual charges remaining thereon prior to the charging thereof for the next successive imaging cycle.

It is believed that the foregoing description is sufficient for purposes of the present application to illustrate the general operation of an electrophotographic machine incorporating the featues of the present invention therein.

Referring now to the specific subject matter of the present invention, development system 28 includes a sensing roller, indicated generally by the reference numeral 54. Sensing roller 54 includes a non-magnetic tubular member 56 having an irregular or roughened exterior surface. Tubular member 56 is mounted for rotation by suitable means, such as ball bearing mounts. A shaft assemble 58 is mounted concentrically within tubular member 56 which serves as a fixed mounting for an elongated magnetic member 60. Tubular member 54 rotates in the direction of arrow 62 to advance the developer material into contact with the photoconductive surface of belt 10. Shaft 58 is electrically conductive and couples tubular member 56 to the input of amplifier 64.

The output from amplifier 64 is electrically coupled to controller 66. Controller 66 is a suitable microprocessor which comprises the requisite algorithm to generate an error signal for controlling voltage source 68. Voltage source 68 electrically biases developer rollers 70, 72 and 74. In operation, the charge on the photoconductive surface of belt 10 induces a charge on tubular member 56 which advances developer material into contact therewith. The potential induced on tubular member 56 produces an electrical output signal which is amplified by high impedance amplifier 64 and transmitted to controller 66 for use in regulating voltage source 68. Sensing roller 54 detects the potential on the photoconductive surface of belt 10 at three specific time intervals. These time intervals correspond to the potential on the photoconductive surface in the inter-document region, i.e. between electrostatic latent images, at the lead edge of the electrostatic latent image, and at the trail edge of the electrostatic latent image recorded on the photoconductive surface of belt 10. The algorithm of controller 66 is arranged to utilize this information to develop a suitable signal for controlling voltage source 68. Developer roller 76 is interposed between developer roller 70 and sensing roller 54. Voltage source 78 electrically biases developer roller 76 to a fixed potential, preferably of about 200 volts. Developer roller 76 is interposed between sensing roller 78 and developing roller 70 to prevent any cross coupling therebetween. This insures a stable system. Developer roller 76 includes a tubular member 80 having irregular roughened exterior surface. Tubular member 80 is mounted for rotation by suitable means such as ball bearing mounts. A shaft assembly 82 is mounted concentrically within tubular member 80 and serves as a fixed mounting for elongated magnetic member 84. Tubular member 80 rotates in the direction of arrow 86 to advance developer material into contact with the photoconductive surface of belt 10. By way of example, tubular member 80 is made preferably from aluminum with magnetic member 84 being made from barium ferrite. Magnetic member 84 has a plurality of magnetic poles impressed about the circumferential surface thereof. Shaft 82 is electrically conductive and couples tubular member 80 to voltage source 78 by suitable means such as brushes or a commutator ring. Developer roller 70 includes a non-magnetic tubular member 88 having an irregular or roughened enterior surface. Tubular member 88 is journaled for rotation by suitable means such as ball bearing mounts. A shaft assembly 90 is mounted concentrically within tubular member 88 and serves as a fixed mounting for an enlongated magnet 92. Tubular member 88 rotates in the direction of arrow 94 to advance developer material into contact with the photoconductive surface of belt 10. By way of example, tubular member 88 is made preferably from aluminum with magnetic member 92 being made from barrium ferrite. Magnetic member 92 has a plurality of magnetic poles impressed upon the circumferential surface thereof. Shaft 90 is electrically conductive and couple tubular member 98 to voltage source 68 via suitable means such as brushes or a commutator ring. In this way the electrical bias applied to tubular member 88 is controlled by controller 66 through voltage source 68. Developer roller 72 includes a non-magnetic tubular member 96 having an irregular or roughened exterior surface. Tubular member 96 is journaled for rotation by suitable means such as ball bearing mounts. A shaft assembly 98 is mounted concentrically within tubular member 96 and serves as a fixed mounting for an elongated magnetic member 100. Tubular member 96 rotates in the direction of arrow 102 to advance developer material into contact with the photoconductive surface of belt 10. Tubular member 96 is made preferably from aluminum with magnetic member 100 being made from barrium ferrite. Magnetic member 100 has a plurality of magnetic poles impressed about the circumferential surface thereof. Shaft 98 is electrically conductive and couples tubular member 96 to voltage source 68 via suitable means such as brushes or a commutator ring. In this way, controller 66 regulates the electrical bias applied to tubular member 96 through voltage source 68. Developer roller 74 includes a non-magnetic tubular member 104 having an irregular or roughened exterior surface. Tubular member 104 is mounted for rotation by suitable means such as ball bearing mounts. A shaft assembly 106 is mounted concentrically within tubular member 104 and serves as a fixed mounting for an elongated magnetic member 108. Tubular member 104 rotates in the direction of arrow 110 to advance developer material into contact with the photoconductive surface of belt 10. Tubular member 104 is made preferably from aluminum with magnetic member 108 being made from barrium ferrite. Magnetic member 108 has a plurality of magnetic poles impressed about the circumferential surface thereof. Shaft 106 is electrically conductive and couples tubular member 104 to voltage source 68 via suitable means such as brushes or a commutator ring. In this way, controller 66 regulates the electrical bias applied to tubular member 104 through voltage source 68.

Sensing roller 54 may also be employed to develop the electrostatic latent image. Furthermore, the output from sensing roller 54 may either be a function of the voltage or current sensed.

Controller 66 determines the desired voltage that voltage source 68 should be applying on developer rollers 70, 72 and 74. Controller 66 employs an algorithm to determine this voltage. If there is no requirement to correct for the effect of the lead and trail edges of the electrostatic latent image on the measured voltage in the interdocument region, i.e. between electrostatic latent images, controller 66 would calculate the voltage output from voltage source 68 using the following equation:

$$V(\text{Bias}) = A + (B)V(\text{Interdocument}).$$

A and B are constants which would be determined empirically by fitting this equation to the potential data obtained from sensing roller 54 for various original documents, with V(Interdocument) being the measured voltage. However, it has been found that the measured interdocument voltage is perturbed by the presence of the lead edge electrostatic latent image voltage and the trail edge electrostatic latent image and/or the insufficient time response of sensing roller 54 to detect the potential of the photoconductive surface of belt 10. Thus, it has been found that it is necessary to correct for the effects of the interaction of the lead and trail edge potentials with the potential of the interdocument region. In order to correct for the effects of the lead and trail edge potentials, controller 66 calculates the desired output voltage from voltage source 68 using the following equation:

$$V(\text{Bias}) = A + (B1)V(\text{Trail Edge}) + (B2)V(\text{Interdocument}) + (B3)V(\text{Lead Edge}).$$

The constants A, B1, B2, and B3 and the times at which the potential is measured to determine the trail edge and lead edge potentials are determined indirectly by using the potential data from sensing roller 54 for various document sizes and fitting this data to the foregoing equation. The trail edge, V(Trail Edge), and lead edge, V(Lead Edge), voltages are measured by sensing roller 54 at empirically determined times just prior to and after measuring the voltage of the interdocument region.

Still another algorithm may be employed which corrects for the effects of the lead and trail edge voltages of the latent image. In this algorithm, a correction factor is added to the uncorrected algorithm. The correction factor is a constant, c, multiplied by the integral of the voltage and may be expressed as follows:

$$V(\text{Bias}) = A + (B)\,V(\text{Interdocument}) + (C)\int_{TLE}^{TTE} V(t)dt$$

TLE and TTE are the time that the lead edge and trail edge measurements are made. It is clear that there are many types of algorithms that may be employed to determine the desired voltage output from voltage source 68. Whenever the selected algorithm, controller 66 utilizes the measured potential or, in lieu thereof, the measured current from sensing roller 54. This signal, in turn, is employed in the selected algorithm within controller 66 so as to generate a control signal for regulating the output from voltage source 68 which, in turn, electrically biases developer rollers 70, 72 and 74.

In recapitulation, it is evident that the development system of the present invention employs a sensing roller which measures the electrical characteristics of the photoconductive surface and generates an electrical signal which is employed to control the electrical bias on a plurality of the developer rollers used to develop the latent image. A developer roller having a fixed electrical bias is interposed between the developer rollers being controlled and the sensing roller. The sensing roller may also be used to develop the latent image. In this way, the electrical bias applied to the various developer rollers is automatically optimized to take into account the variations in the electrical characteristics of the photoconductive surface.

It is, therefore, evident that there has been provided in accordance with the present invention a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An electrophotographic printing machine of the type having a photoconductive member with at least one electrostatic latent image recorded thereon, wherein the improvement includes:

means for supporting a developer material closely adjacent to the photoconductive member;

means, coupled to said supporting means, for generating a control signal as a function of the electrical potential on the photoconductive member;

first means for developing the electrostatic latent image;

first means for electrically biasing said first developing means to a substantially fixed electrical bias;

second means for developing the electrostatic latent image, said first developing means being interposed between said second developing means and said supporting means; and second means, responsive to the control signal from said generating means, for electrically biasing said second developing means.

2. A printing machine according to claim 1, wherein said supporting means develops the electrostatic latent image recorded on the photoconductive member.

3. A printing machine according to claim 2, wherein said generating means generates the control signal as a function of the electrical potential on the photoconductive member in the region between successive electrostatic latent images recorded on the photoconductive member.

4. A printing machine according to claim 3, wherein said generating means further generates the control signal as a function of the electrical potential on the photoconductive member in the regions of the trail edge and lead edge of the electrostatic latent image recorded thereon.

5. A printing machine according to claim 2, wherein said supporting means includes:

a first tubular member mounted rotatably for transporting developer material closely adjacent to the photoconductive member; and a first magnetic member disposed interiorly of and spaced from said first tubular member to attract the developer material thereto.

6. A printing machine according to claim 5, wherein said first developing means includes:

a second tubular member, spaced from said first tubular member, for transporting developer material closely adjacent to the photoconductive member; and a second magnetic member disposed interiorly of and spaced from said second tubular member to attract the developer material thereto.

7. A printing machine according to claim 6, wherein said second developing means includes:

a third tubular member, spaced from said second tubular member, for transporting developer material closely adjacent to the photoconductive member; and a third magnetic member disposed interiorly of and spaced from said third tubular member to attract the developer material thereto.

8. A printing machine according to claim 7, wherein said second developer electrical biasing means includes a variable voltage source electrically connected to said third tubular member.

9. A printing machine according to claim 8, wherein the generating means includes:

an amplifier electrically connected to said first tubular member; and a controller electrically connected to said amplifier and said variable voltage source.

10. A printing machine according to claim 9, wherein said first developer electrical biasing means includes a fixed voltage source electrically connected to said second tubular member.

* * * * *